United States Patent [19]

Williams

[11] Patent Number: 4,580,201

[45] Date of Patent: Apr. 1, 1986

[54] STEADY LIGHT XENON UNIT

[76] Inventor: Theodore M. Williams, 1360 Kenecki Pl., Hilo, Hi. 96720

[21] Appl. No.: 649,174

[22] Filed: Sep. 10, 1984

[51] Int. Cl.[4] ..... F21Q 3/00

[52] U.S. Cl. ..... 362/227; 362/240; 362/363; 315/241 S; 315/322

[58] Field of Search ..... 315/241 S, 322, 324, 315/200 A; 362/184, 210, 227, 235, 236, 240, 363

[56] References Cited

U.S. PATENT DOCUMENTS 3,310,670 3/1967 Sheppard ..... 362/235

3,488,485 1/1970 McGann ..... 362/235

3,953,763 4/1976 Herrick ..... 315/241 S 4,161,021 7/1979 George ..... 362/240

*Primary Examiner*—Magdalen Y. C. Moy

*Assistant Examiner*—David A. Okonsky

[57] ABSTRACT

An electrical illumination device, using a plurality of Xenon stroboscopic lights, with the bulbs mounted around a column that sets on a case containing the principal components of the stroboscopic lights with electrical conductors and switching devices to cause the lights to pulse with a steady even-appearing light. The plurality of lights to be enclosed by a weather-resistant globe fastened to the case.

4 Claims, 7 Drawing Figures

STEADY LIGHT XENON UNIT

SUMMARY

The primary objective of this invention is to provide an extremely efficient light for versatile general civilian and/or military use.

Another objective of this invention is to provide an illuminating device that produces large amounts of illumination with a substantial reduction in the heat dissipated by the light, thereby making it desireable for indoor lighting in television and movie studios and in similar places that are now hindered by the extreme heat given off by high-powered incandescent lights.

A further objective of this invention is to make it possible for outdoor stadiums, airports and the like to be able to afford adequate electric light by means of much less expensive and smaller wiring than conventional wiring now in use for such purposes.

Still another objective of this invention is to provide suitable lighting that can be easily transported and quickly made operational in time of natural disasters where the main source of power is cut off. One small, hand-held electric 2000 watt portable generator with my Cluster Element Strobe Light Bulb would produce more light than the conventional heavy 3 ton electric generator set of 140,000 watts.

Various objectives and advantages for multiple use of this invention will become more apparent from the following descriptions of the drawings, illustrating herewith the presently preferred embodiment thereof and wherein.

DESCRIPTION OF THE PREFERRED EMBODIMENT

Figures 1, 2, 3, 4:
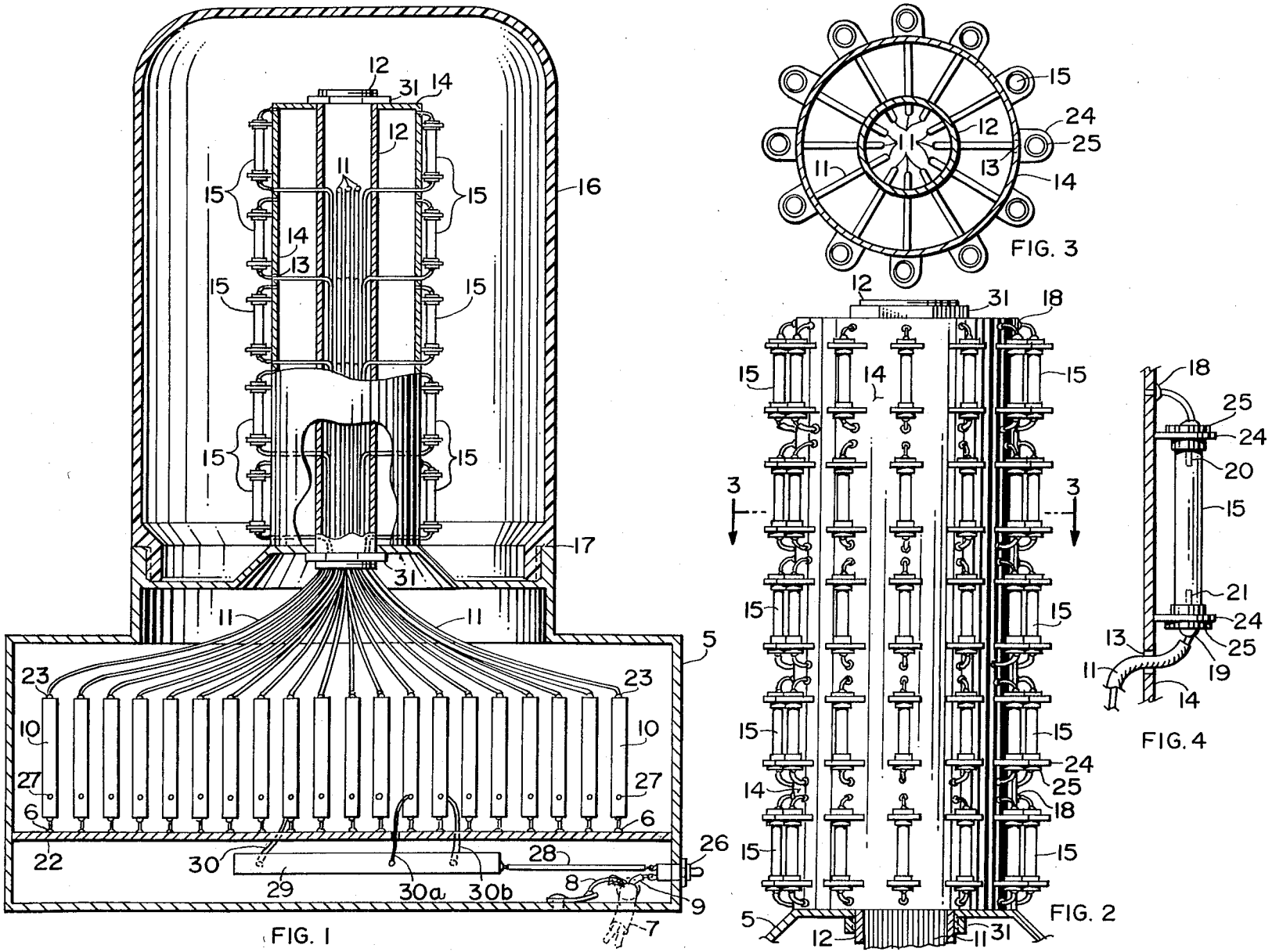
FIG. 1 is a side elevational view, partly broken away.
FIG. 2 is a side elevational view of the clustered elements of the strobe light unit.
FIG. 3 is an overhead elevational view, taken across top of cluster column between lines 3—3 FIG. 2.
FIG. 4 is a fragmentary vertical view partly broken away of items 14 and 15, as shown in FIG. 2.

FIG. 1 is a side elevational view, partly broken away of a multi 60-element stroboscopic light used in the example. The xenon bulb 15 is mounted on a polished steel column 14. The stroboscopic light 15 is grounded on the column 14 at point 18. The metal case 5 acts as a ground for the necessary electrical negative ground. The case 5 is sufficiently large to contain the individual strobe units 10, less bulb and lead wire, and all controls with wiring. In the example, 20 of the total 60 stroboscopic units 10 are shown. The addition of the 40 units and wires (see FIGS. 5 and 6) which are basically similar, would only tend to confuse the illustration.

The stroboscopic units are 10 and are grounded to point 6 on the sub-base 22. The electric primary positive wire is 9. The entrance power line is 7. The outer steel column of the cluster light column is 14, and the inside wire conduit is 12.

The numerous holes to admit the plurality of wires are 13 in both the inner and outer sections of the cluster column. The high voltage wire 11 runs between the xenon bulb 15 from positive terminal 19. It terminates at terminal 23 on the discharge side of the high voltage 23 on the stroboscopic lights unit 10. Each of the necessary plurality lights is complete in its casing 10, except the lead wire 11 to the xenon bulb 15.

The incoming primary power 9 has a cut-off switch 26. A distribution terminal of some type may be inserted at point 28 of the incoming power before distribution to each of the 60 stroboscopic units cases 10, through the distribution panel 29 through individual wires 30 to the strobe case unit 10 at entering power point 27. The even and steady illumination of the 60 strobe lights may be accomplished by a voltage difference in some of the wires, and by varying the components of the strobe units, and by the use of motorized switches feeding power through point 28 to the distributor 29 through wire 30, **30*a* and 30*b* to contact point 27** at which electric energy enters the strobe unit.

The frosted cover (or globe) is 16 and its lower closure point 17. The nuts 31 hold inner column 12 and are the top and bottom fasteners for the column. It is noted that the carryover of an individual stroboscopic light flash is often as long as $\frac{3}{4}$ of a second. With a large plurality of strobe lights flashing within a confined space, i.e., a diffuser globe, there cannot be a noticeable blinking effect, thereby producing a continuous and even-appearing cool light.

FIG. 2 is a side elevational view of the cluster stroboscopic xenon light unit. The top of the metal case 5 holds the stroboscopic light element 14, less the bulbs 15 shown mounted on tower 14.

An inner perforated pipe conduit 12 has two fastener nuts 31 to hold the column 14 on to the lower case 5. The top of each strobe bulb is grounded 18 to the tower 14 which shares a common ground with lower case 5. The opening 13 to the outer column 14 is for the lead in high tension wires 11 between the strobe lights 15 and the discharge on the strobe units in case 5 (FIG. 1) is point 23. A fragmented section of the strobe light casing is shown 10.

FIG. 3 is a plan view taken across section 3—3 in FIG. 2. The outer column column is 14. The mounted stroboscopic lights are 15. The high tension wire is 11 and the innerperforated column is 12. The positive side of the xenon bulb is 19.

FIG. 4 is a fragmentary vertical view partly broken away of Item 14 and 15 shown in FIG. 2. The xenon bulb 15 which is filled with a gas of the same name has a negative contact point 20 and a positive point 21. It is the gases arcing across this xenon gas-filled space that give the exceedingly high efficient light. The insulation grommets are 25, situated at the top and bottom of the bulb. The support brackets, which in manufacture would be pressed out of the column, are 24 to support the bulb. The opening in the column Section 14 is opening 13 and the entering high tension wire is 11. The ground point 18 is on the column 14.

Figure 5:
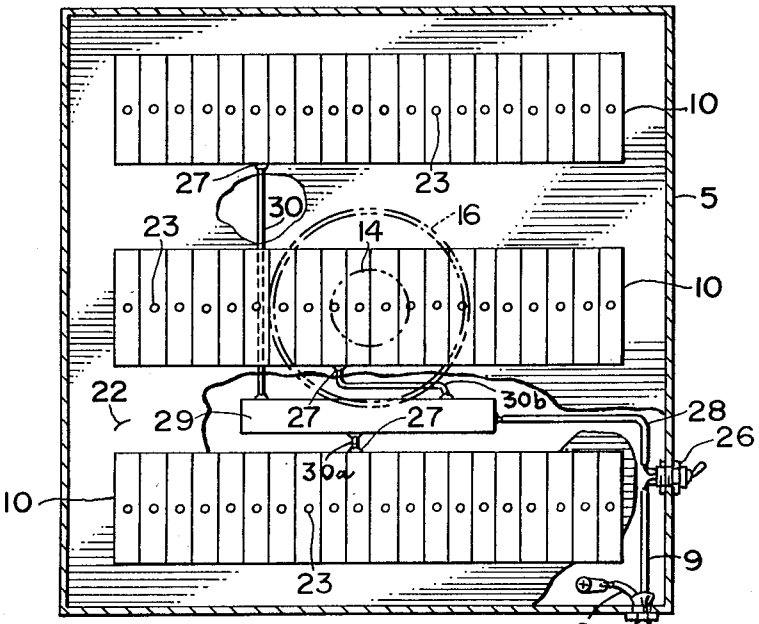
FIG. 5 is a plan view of drawings.

FIG. 5 is a plan view of the arrangement of the major components of the stroboscopic steady illumination light. The main body of the individual strobe lights are 10. The case 5 holds the strobe units and controls, less the xenon bulb which is in the column 14 and the connecting high tension wire 11. The entering electric line is 7 and the cut-off electrical switch is 26. The distribution point for the electrical energy is 28 and the distribution panel is 29. The connecting wire between this distribution panel 29 and the entering power to the main body of the individual strobe lights 27 is 30. The outer supporting column tower is 14 and the inner column is 12.

Figure 6:
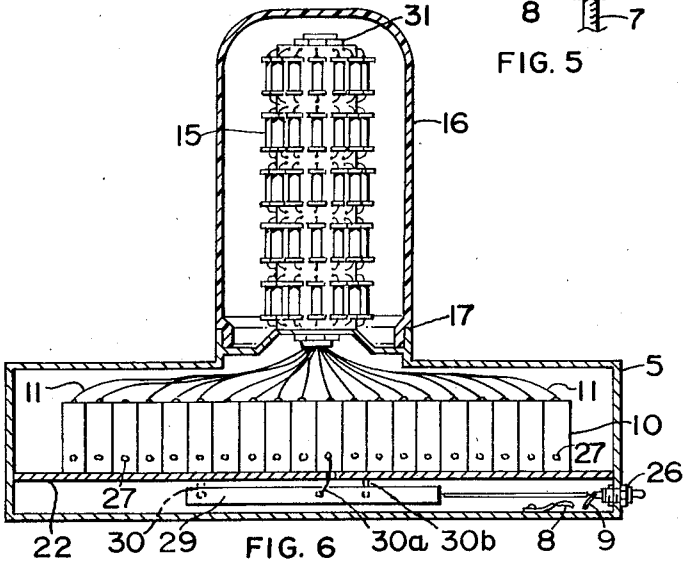
FIG. 6 is a side elevation view of drawings.

FIG. 6 is an elevational view of the stroboscopic light. The main body case is 5. The column placed on top of the case is 14. The outer diffusing globe enclosing the column is 16. The individual strobe light bulbs are 15. The attachment of the globe to the case is 17. The sub-bottom of the case is 22. The ground for the strobe lights individual cases is 6. The discharge terminals on the strobe light bodies are 23. The lead wire between the strobe bulb and the strobe body is 11. The individual strobe casings are 10.

Figure 7:
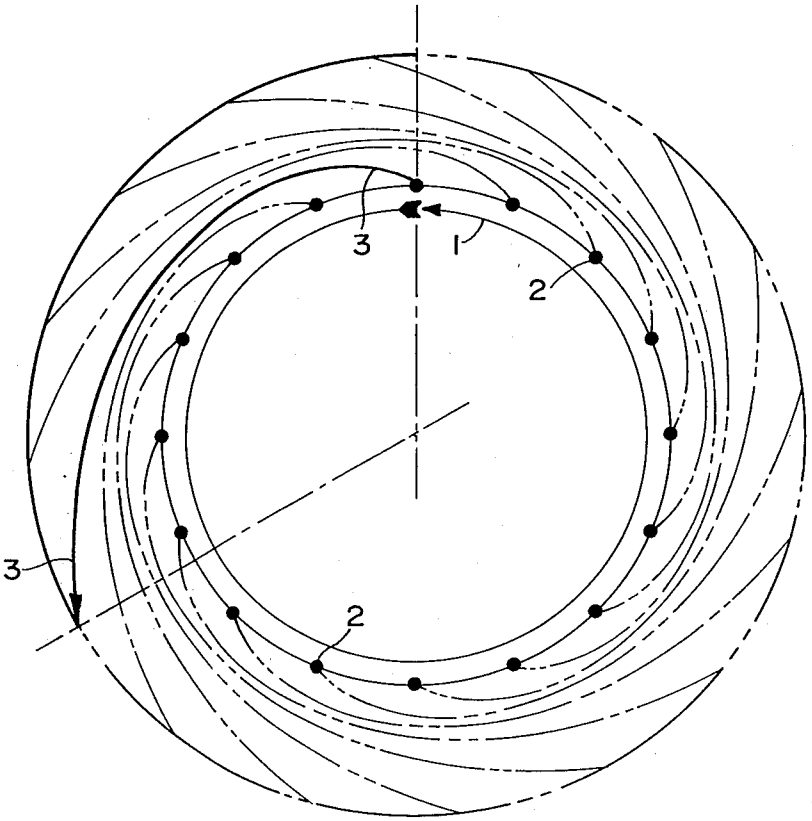
FIG. 7 is a diagram drawing showing the stroboscopic flash sequence.

FIG. 7 is a diagram drawing showing the stroboscopic flash time-lapse over a one second interval.

EXPLANATION OF CLAIMS

The idea of arranging a cluster of many stroboscopic light elements 15 to produce an effect of steady and continuous light is new and novel. It is possible to make only minor changes to presently manufactured strobe units in order to achieve a continuous even illumination. This can be accomplished by removing the casings and bulbs and placing bulb 15 in the column 14 and connecting a wire 11 from the bulb 15 to the stroboscopic unit 10. By combining and placing a substantial number of the stroboscopic light units in a common base 5 and tower column 14 and the whole covered by a frosted glass or plastic diffuser cover (globe) a constant steady and even light can be easily produced. This would have the advantage of achieving brilliant illumination at a fraction of the cost of present electrical lighting systems.

Stroboscopic lights that are production manufactured have a varying flashing time in any given group. When assembled in multiple units in large quantities within a single light bulb, as described above, it will produce an even illumination due to the lingering lag of the individual flash units. This inventor later will claim any means whatsoever to cause an assembly of multistroboscopic lights so arranged as to flash sequentially to produce an even illumination as his invention.

In the manufacture of stroboscopic lights it is relatively easy to vary the flashing time of individual strobe units by varying the construction of the internal components of the capacitor. The electrical charge to the 60, or any plurality of units, may be varied by a 1750 revolutions per minute motor reduced down to one revolution per second to drive an electrical switch which charges the stroboscopic lights.

Some means to alter the line voltage to the various units will also accomplish the alternate flashing to produce constant, non-flickering illumination. The list is endless.

EXAMPLES OF EFFICIENCY DIFFERENCES 300,000 incandescent light candlepower using 12.5 amperes at 12 volts equals 150 watts Versus 500,000 Xenon stroboscopic candlepower using 0.3 amperes at 12 volts equals 3.6 watts This is about forty (40) times more efficient than present electric incandescent illumination.

In alternating current, which alternates 60 cycles a second, the fluctuation is not noticeable, as normal vision only registers in frames of less than 60 cycles. The basic idea of my cluster element stroboscopic light bulb is to cause a sufficient plurality of stroboscopic lights in close proximity to one another, and within a frosted or clear, glass or plastic diffusing globe to produce a sychronized flashing effect of sufficient eveness to produce the effect of constant, steady and continuous illumination.

Various modifications and changes are contemplated and may be resorted to, without departing from the basic function and scope of the invention, as hereinafter defined in the appended claims.

I claim as my invention:

1. An illumination device comprising: a support base means, a modulating switching means, a plurality of stroboscopic lights, electrical conduction means leading from said modulating switching means to said plurality of stroboscopic lights and a transparent globe surrounding at least said lights and fastened to said base means; said switching means distributing electrical pulses to individual ones of said plurality of stroboscopic lights in a manner to produce an even-appearing and steady stream of light from said globe.

2. An illumination device according to claim 1 wherein said plurality of stroboscopic lights are supported about a column.

3. An illumination device according to claim 1 wherein said globe is frosted.

4. An illumination device according to claim 1 wherein said globe is colored.

* * * * *